318-135 SR
5/16/78 XR 4,090,113

United States Patent [19]
Ogishi

[11] 4,090,113
[45] May 16, 1978

[54] METHOD OF DRIVING DOOR OF AUTOMATIC DOOR ASSEMBLY

[75] Inventor: Masaaki Ogishi, Kurobe, Japan

[73] Assignee: Yoshida Kogyo, K.K., Tokyo, Japan

[21] Appl. No.: 694,607

[22] Filed: Jun. 10, 1976

[30] Foreign Application Priority Data

Jun. 10, 1975 Japan ..... 50-69903

[51] Int. Cl.² ..... H02P 3/20

[52] U.S. Cl. ..... 318/282; 318/135; 318/626; 318/468

[58] Field of Search ..... 49/360; 310/13; 318/282, 626, 135, 446, 466–469

[56] References Cited

U.S. PATENT DOCUMENTS 3,039,764 6/1962 Heinsman et al. ..... 318/282
3,462,883 8/1969 Reeks et al. ..... 49/360
3,621,349 11/1971 Reyx ..... 310/13

*Primary Examiner*—Robert K. Schaefer
*Assistant Examiner*—Michael K. Mutter
*Attorney, Agent, or Firm*—Hill, Gross, Simpson, Van Santen, Steadman, Chiara & Simpson

[57] ABSTRACT

A method of driving a door of an automatic door assembly by a linear motor mounted within the automatic door assembly. The method comprises the steps of driving the door by at least a normal propulsion force of the linear motor, driving the door by a propulsion force which may range from zero to nearly the normal propulsion force, and then driving the door by the normal force again thereby reducing the speed of travel of the door during its opening and closing intervals.

1 Claim, 10 Drawing Figures

METHOD OF DRIVING DOOR OF AUTOMATIC DOOR ASSEMBLY

BACKGROUND OF THE INVENTION

1. Field of the Invention

The present invention relates to a method of driving a door of an automatic door assembly and more particularly, to a method of driving the door by a linear motor mounted within the automatic door assembly.

2. Description of the Prior Art

Automatic door assemblies having a linear motor as a prime mover are advantageous in that the linear motor can drive the door linearly without any special power transmission mechanism, the motor is simple and durable in construction, and it can be manufactured less costly. However, they also have a disadvantage in that the linear motor, which has a relatively reduced stroke, is actuated only for a period during which time the slip of the linear motor remains relatively large. Therefore, when the propulsion force of the linear motor is too small, the door is retarded and tends to stop before it reaches the end of its stroke or travel, and when the propulsion force is too great, the door is driven so rapidly that the door frame is subjected to the full impact of the moving door. In addition, since frictional resistance and inertia acting on the door vary with the structure and extent of movement of the door when the latter travels, it is extremely difficult to determine a propulsion force for the motor which prevents the door from stopping before it comes to the end of its stroke or from bumping against the door frame at the end of its travel or stroke. Various attempts have heretofore been made to stop the door exactly at the ends of the door stroke by retarding the door during its stroke, thereby preventing the door from striking the outer frame. One such attempt has been to reduce the speed of the door electrically by giving an opposite propulsion force to the linear motor during a final portion of the door stroke. However, this has led to a drawback in that various intricate control devices such as a speed detecting device and a position detecting device which must be adjusted precisely need to be added to the automatic door assembly. Another such attempt has been to provide a pair of cushioning devices such as self-returning type air cylinders at the ends of stroke of the movable door so as to dampen the door speed mechanically.

A problem with the automatic door assembly having the cushioning devices is that an additional propulsion force must be applied at the ends of the door stroke to overcome the reaction force of the cushioning devices. Furthermore, a common difficulty experienced with these prior proposals is that the door cannot be moved smoothly over its entire stroke and is subjected to stresses since the door is forcibly stopped at the ends of the stroke.

SUMMARY OF THE INVENTION

It is a principal object of the present invention to provide a method of driving a door of an automatic door assembly.

It is another object of the present invention to provide a method of the type described which can drive the door smoothly over its stroke and prevent it from hitting the door frame at the ends of its strokes.

According to the invention, there is provided a method of driving a door of an automatic door assembly by a linear motor mounted within the automatic door assembly. The method comprises the steps of driving the door by at least a normal propulsion force of the linear motor during an initial period of the stroke of the door, and driving the door by a propulsion force which is in the range from zero to said normal propulsion force after the lapse of said initial period of the door stroke, thereby reducing the speed of travel of the door.

Many other advantages and features of the present invention will become manifest to those versed in the art upon making reference to the detailed description and the accompanying sheets of drawings in which preferred embodiments incorporating the principles of the present invention are shown by way of illustrative example.

DETAILED DESCRIPTION OF THE PREFERRED EMBODIMENTS

Figure 1:
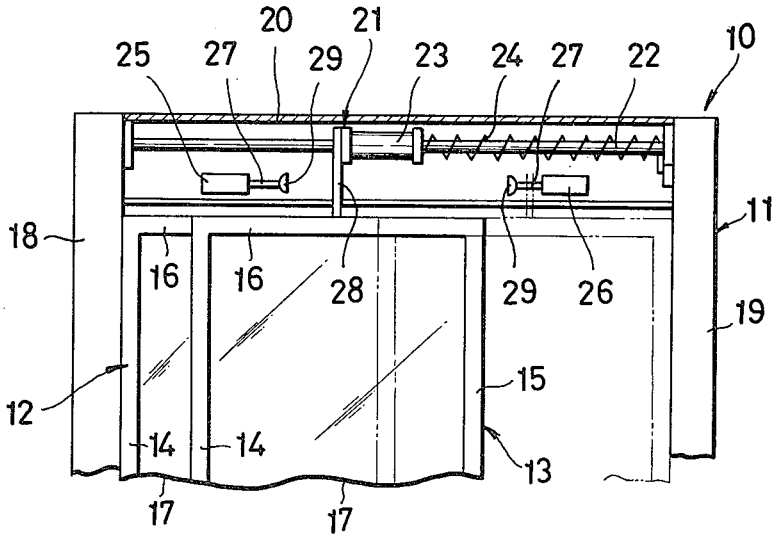
FIG. 1 is a fragmentary front elevational view with parts cut away of an automatic door assembly driven in accordance with a method of the present invention.

Referring to FIG. 1, an automatic door assembly 10 generally comprises an outer frame 11 to be mounted in a portal in a building and a pair of doors 12, 13, the door 12 being fixed to the frame 11 and the door 13 being horizontally movable within the frame 11 in order to open and close the portal. Each of the doors 12, 13 has an inner frame including a pair of stiles 14, 15, a top rail 16, and a glass pane 17 surrounded and held in place by the inner frame. The outer frame 11 has a pair of side jambs 18, 19 and a head 20 interconnecting the top ends of the side jambs 18, 19.

The head 20 contains therein a linear motor 21 having a reaction rod 22 extending horizontally between the side jambs 18, 19 and a movable member 23 in the form of a hollow cylinder fitted over the rod 22 with a clearance therebetween, the movable member 23 having a pair of coils for providing a shifting magnetic field. A power cable 24 extends from one of the side jambs, here the jamb 19, around the reaction rod 22 to the movable member 23 where it is connected to the windings. The head 20 also has a pair of air cushion cylinders 25, 26 of the self-returning type mounted therein and spaced apart a distance substantially equal to the stroke of the movable door 13, the cylinders 25, 26 serving to dampen the movement of the movable door 13 at the ends of its opening and closing travel or strokes. The air cushion cylinders 25, 26 may however be removed under certain conditions.

Each of the air cushion cylinders 25, 26 has a piston rod 27 normally urged to its projecting position by a coil spring, not shown, in the cylinder. The movable member 23 of the linear motor 21 is provided with a downwardly extending bar 28 fixed thereto and having its bottom end connected centrally with the top rail 16 of the movable door 13. The piston rods 27 have at their distal ends rubber members 29 with which the bar 28 engages when the door 13 is just about to reach its fully open or closed position. By the term "normal propulsion force" used herein is meant a force which is sufficiently large to overcome the frictional resistance of the movable door including the linear motor and which is sufficiently small to prevent the stile 15 of the door 13 from striking the side jamb 19 when the door 13 is closed.

Figure 2A:
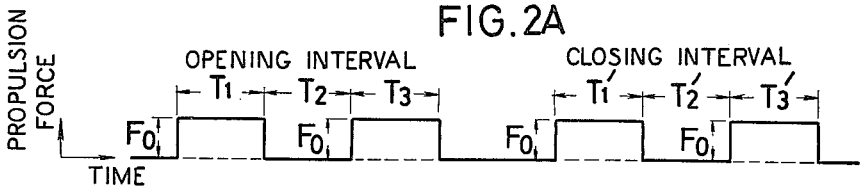
FIGS. 2A through 2D are graphs each showing the relation between time and propulsion force of the linear motor actuated according to a method of the present invention.

According to a method of the invention, as shown in FIG. 2A, the normal propulsion force $F_0$ is interrupted at a central period $T_2$ of each of the door opening and closing intervals. The linear motor 21 is driven by a normal operating voltage which provides the propulsion force $F_0$ during an initial period $T_1$ or $T_1'$, then by its inertia and that of the door 13 during the period $T_2$ or $T_2'$, and finally, the propulsion force $F_0$ is again restored during a final period $T_3$ or $T_3'$. The door 13 is retarded by frictional resistance of the door and the linear motor during the period $T_2$ or $T_2'$ and accelerated again during the final period $T_3$ or $T_3'$. However, due to the inertia of the door and linear motor, the door 13 does not reach its full speed before arriving at the end of the stroke. The door 13 is thus prevented from bumping against the door frame 11 and is smoothly opened and closed.

Figure 2B:
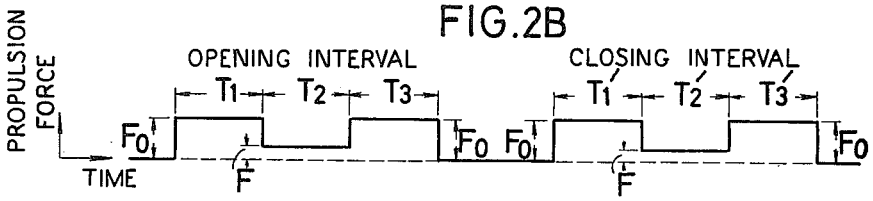

In FIG. 2B, the propulsion force $F_0$ is reduced at the central periods $T_2$ and $T_2'$ of the opening and closing intervals to a smaller propulsion force F which may range from zero to nearly the propulsion force $F_0$, thereby reducing the speed of travel of the door 13.

Figure 2C:
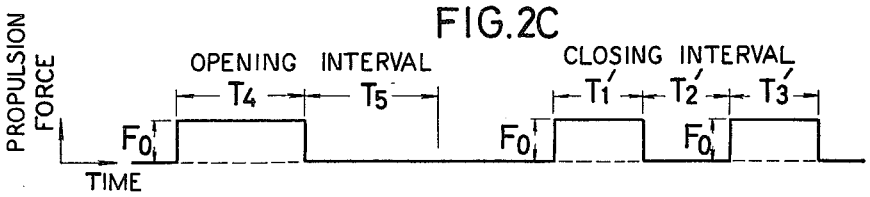
Figure 2D:
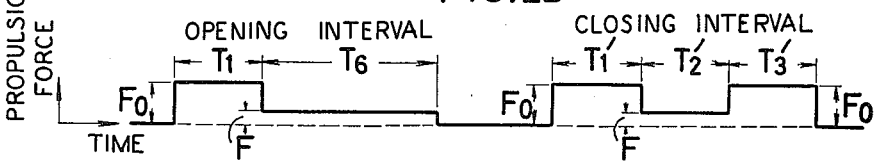

Since the door 13 is permitted to stop short of its fully open position, it may be driven in accordance with the patterns of FIGS. 2C and 2D in which the propulsion force $F_0$ is removed or reduced after the lapse of a suitable period in the door opening interval. More specifically, the propulsion force $F_0$ is cut off upon lapse of a period $T_4$ which is longer than the initial period $T_1$, as shown in FIG. 2C. In this instance, the door 13 is first driven by the linear motor 21 during the period $T_4$, and then is moved by its own inertia during a remaining period $T_5$.

With reference to FIG. 2D, the driving force $F_0$ is reduced to the propulsion force F after the lapse of the initial period $T_1$ and held at the force F during a remaining period $T_6$.

Figure 3:
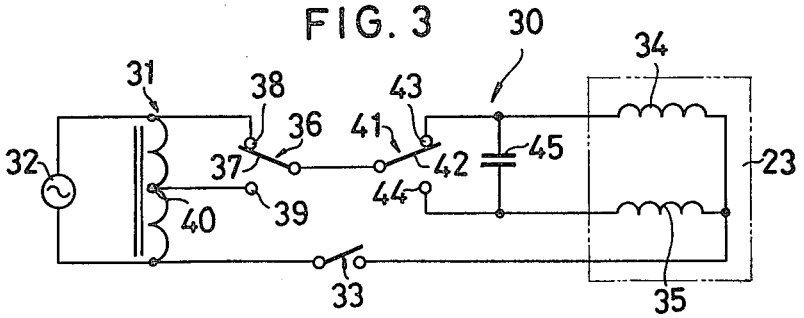
FIGS. 3 through 6 are circuit diagrams for controlling the linear motor in accordance with the invention.

FIG. 3 illustrates an electric circuit 30 provided for effecting the method according to this invention. The circuit 30 includes an autotransformer 31 connected at its end terminals to a single-phase a.c. source 32. The contacts of a main switching relay 33 are connected between one of the end terminals of the autotransformer 31 and a common terminal of a pair of parallelconnected first and second coils 34, 35 mounted within the movable member 23 of the linear motor 21. There is provided a first relay 36 having contacts of the single-pole double-throw type including a moveable pole 37 and two contacts 38, 39, the contact 38 being connected to the other end terminal of the autotransformer 31 and the contact 39 to a tap 40 of the autotransformer 31. The first relay 36 is normally open during which time the pole 37 contacts the contact 38. A second relay 41 of the single-pole double-throw type is provided which has a movable pole 42 coupled with the pole 37 of the first relay 36. A contact 43 of the second relay 41 is connected to the first winding 34 and a contact 44 is connected to the second winding 35. The second relay 41 is normally open during which time the pole 42 engages the contact 43. Connected across the contacts 43, 44 of the second relay 41 is a capacitor 45 serving as a phase-advancer for one of the windings 34, 35 which is selected by the second relay 41.

Assuming that the main relay 33 is closed and the first and second relays 36, 41 are de-energized, the full voltage of the power source 32 is applied to the winding 34 and, through the capacitor 45, the winding 35, when the door 13 is driven by the normal propulsion force $F_0$. When the first relay 36 is actuated to shift the pole 37 to the contact 39, a voltage which is produced by dropping the power supply voltage through the autotransformer 31 is applied to the winding 34 and, through the capacitor 45, the winding 35, whereupon the door 13 is driven by a propulsion force F which may range from zero to nearly the propulsion force $F_0$. The direction of movement of the movable member 23 of the linear motor 21 can be changed by shifting the pole 42 from the contact 43 to the contact 44 or vice versa, the switching of the relay 41 thus switching the direction of the shifting magnetic field formed by the windings 34, 35. The autotransformer 31 may be a variable-ratio autotransformer whereby an output voltage across the common line can be varied continuously.

Figure 7:
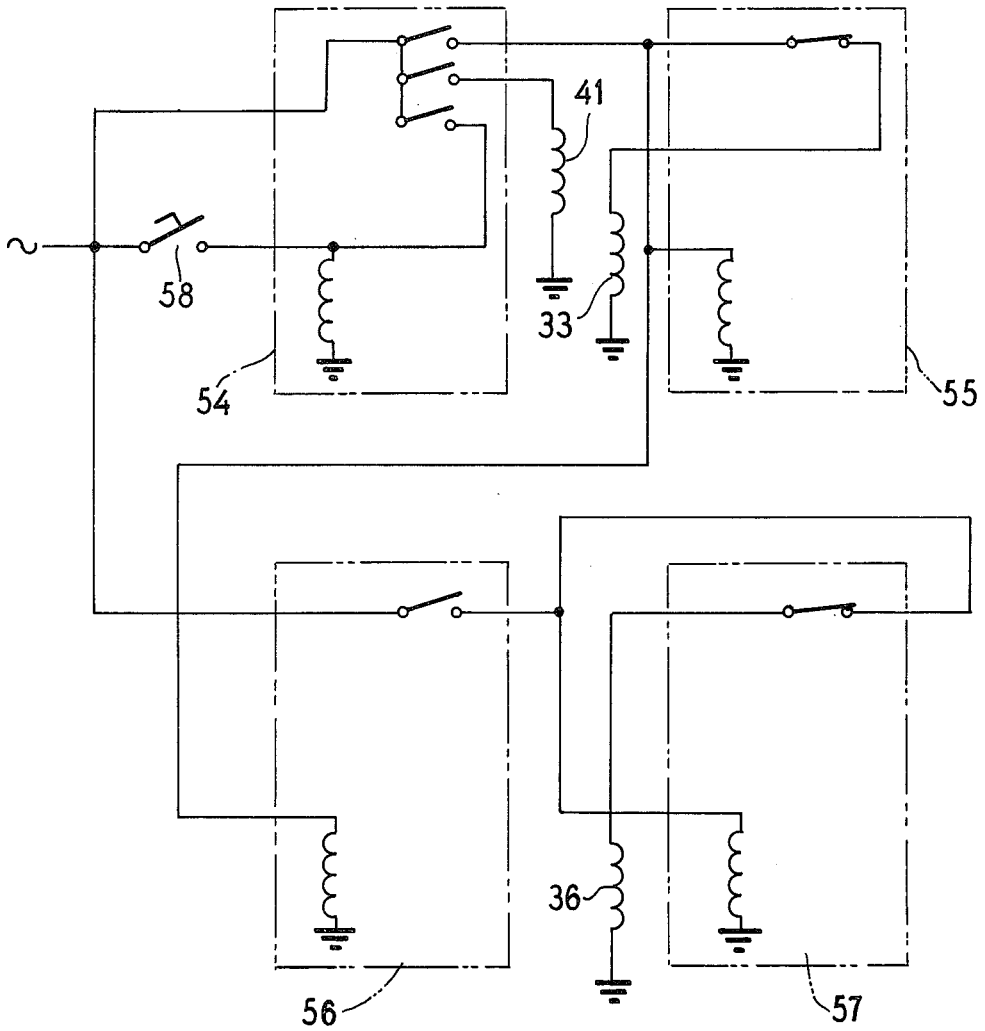
FIG. 7 is a control circuit for FIGS. 3 and 4.

With the circuit construction of FIG. 3, a mode of operation of the automatic door assembly 10 according to the pattern of FIG. 2B is described below. Four timers 54–57 (FIG. 7) are operatively associated with the circuit components. More specifically, a first timer 54 serves to determine a time interval during which the door 13 is open. That is, when a switch 58 under a door mat, not shown, on the floor is actuated, the first timer 54 sets a time interval after which the door 13 starts closing. A second timer 55 is energized when the main relay 33 is actuated and, after the lapse of a preset time interval which is slightly longer than the door opening interval, the second timer 55 turns the main relay 33 off. A third timer is actuated at the same time as the second timer and, after the lapse of a time interval of the initial period $T_1'$, energizes the first relay 36 and a fourth timer is actuated to de-energize the first relay 36 after the lapse of a preset time interval.

When a person steps on the door mat, the switch 58 under the mat is thrown to actuate the main relay 33 and the second relay 41, the first relay 36 remaining de-energized. The door 13 starts opening and is driven by the normal propulsion force $F_0$, or a force greater than the force $F_0$, during the initial period $T_1$ of the opening interval. After the lapse of the initial time interval $T_1$, the third timer actuates the first relay 36 to apply a dropped voltage to the first and second coils 34, 35, thereby propelling the door 13 by the smaller propulsion force F. Upon lapse of a preset time interval, the first relay 36 is de-energized again by the fourth timer, so that the door 13 is driven by the stationary propulsion force $F_0$, or a force greater than the force $F_0$. Simultaneously with the lapse of the door opening interval, the second timer de-energizes the main relay 33 thereby completing the opening of the door 13. With the switch 58 under the door mat open upon passage of the person through the door, the first timer 54 operates, after a preset time interval, to again actuate the main switching relay 33 so as to initiate the door closing operation. The second relay 41 is de-energized by the first timer 54 when the door closing operation begins. The sequence of switching of the relays 33 and 36, and operation of the second and third timers 55, 56 during the door closing operation is completely identical so that during the door opening operation. The internal construction of the timer switches 54–57 is conventional and is only schematically illustrated and known timers of such type typically include timing cams that provide a program.

Figure 4:
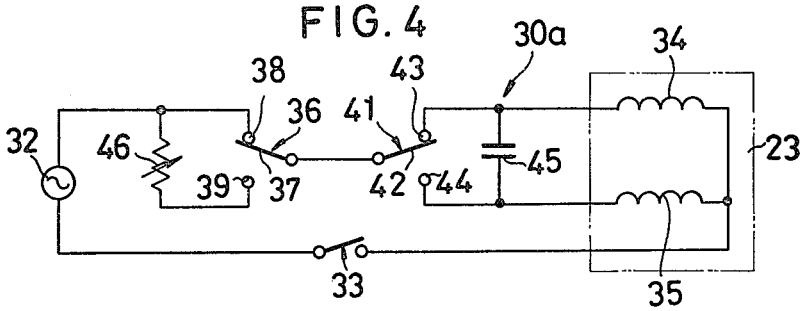

FIG. 4 illustrates a linear motor control circuit 10a constructed in accordance with another embodiment, wherein a variable resistor 46 is used instead of the autotransformer 31 in the circuit 30 shown in FIG. 4.

Figure 5:
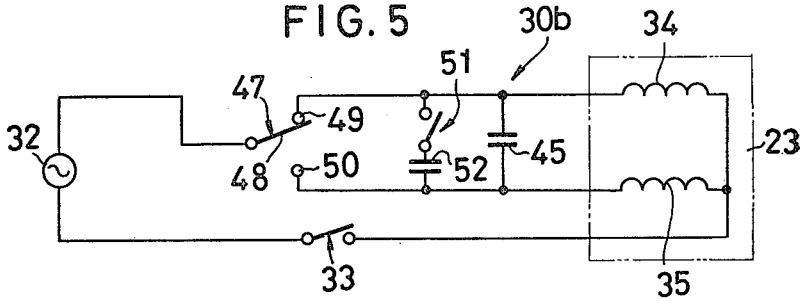

According to still another embodiment shown in FIG. 5, a control circuit 30b includes a single-pole double-throw type relay 47 having a movable pole 48 connected to one terminal of the power supply 32 and a pair of contacts 49, 50, the contact 49 being coupled to the first coil 34 and the contact 50 to the second coil 35. There is provided another relay 51 having contacts connected in series with a capacitor 52, the relay 51 and the capacitor 52 being connected in parallel with the capacitor 45. The relay 47 is used to change the direction of the shifting magnetic field formed by the windings 34, 35. The relay 51 serves to vary the strength of the propulsion force of the linear motor.

Figure 6:
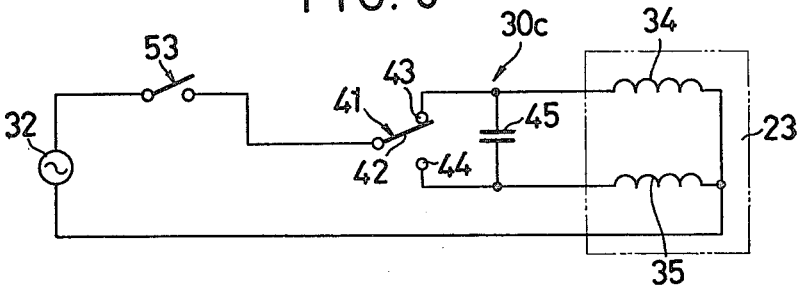

With respect to FIG. 6, an electric circuit 30c finds particular utility for effecting the methods according to the patterns shown in FIGS. 2A and 2C. The contacts of a main relay 53 are connected between the power source 32 and the movable pole 42 of the second relay 41. When the main relay 53 is energized, the full voltage is applied to the windings 34, 35 of the linear motor 21 to drive the latter by the normal propulsion force $F_0$. When the main relay 53 is then de-energized, the normal propulsion force $F_0$ is interrupted to let the door 13 be moved only by its own inertia the door 13 tends to of motion.

Although various minor modifications may be suggested by those versed in the art, it should be understood that I wish to embody within the scope of the patent warranted herein, all such embodiments as reasonably and properly come within the scope of my contribution to the art.

What I claim as my invention:

1. A method of driving an electric door motor of an automatic door assembly, comprising the steps of:

(a) driving the motor by at least a normal operating voltage during an initial period of the stroke of the door;

(b) reducing said voltage to a level below said normal operating voltage after the lapse of said initial period of the door stroke to reduce the moving-force applied to the door;

(c) restoring and maintaining at least the normal operating voltage for the time needed to drive the door to the end of its stroke; and (d) thereafter, removing said voltage.

* * * * *